US008702527B2

(12) United States Patent
Curtwright

(10) Patent No.: US 8,702,527 B2
(45) Date of Patent: Apr. 22, 2014

(54) BILLIARD RACK

(76) Inventor: James William Curtwright, Champlin, MN (US)

( * ) Notice: Subject to any disclaimer, the term of this patent is extended or adjusted under 35 U.S.C. 154(b) by 0 days.

(21) Appl. No.: 13/374,651

(22) Filed: Jan. 4, 2012

(65) Prior Publication Data

US 2012/0316003 A1 Dec. 13, 2012

Related U.S. Application Data

(60) Provisional application No. 61/520,648, filed on Jun. 13, 2011.

(51) Int. Cl.
*A63D 15/00* (2006.01)

(52) U.S. Cl.
USPC ..... 473/40; 473/2

(58) Field of Classification Search
USPC ..... 473/21, 22, 26, 40, 41, 2, 1; D21/782, D21/783; 206/315.9
See application file for complete search history.

(56) References Cited

U.S. PATENT DOCUMENTS

| | | | | | |
|---|---|---|---|---|---|
| 242,584 | A | * | 6/1881 | Bensinger | 273/123 R |
| 286,114 | A | * | 10/1883 | Carr | 211/14 |
| 305,913 | A | * | 9/1884 | Gately | 473/9 |
| 830,180 | A | * | 9/1906 | Schultz | 273/123 R |
| 855,728 | A | * | 6/1907 | Pingrey | 273/123 R |
| 1,157,053 | A | * | 10/1915 | Smith | 473/41 |
| 1,245,820 | A | * | 11/1917 | Teryua | 273/123 R |
| 1,468,336 | A | * | 9/1923 | Vondersloot | 273/123 R |
| 1,613,372 | A | * | 1/1927 | Barker | 473/21 |
| 1,784,068 | A | * | 12/1930 | Johnson | 473/17 |
| 1,801,142 | A | * | 4/1931 | Crosthwait | 473/19 |
| D90,752 | S | * | 9/1933 | Deming | D21/312 |
| 2,236,572 | A | * | 4/1941 | King | 273/127 R |
| 2,767,854 | A | * | 10/1956 | Barrett | 211/85.7 |
| 3,141,673 | A | * | 7/1964 | Scott | 273/123 R |
| 3,220,122 | A | * | 11/1965 | Miller | 473/2 |
| 3,399,890 | A | * | 9/1968 | Galedrige | 473/18 |
| 3,825,258 | A | * | 7/1974 | Frierman | 473/3 |
| 3,902,719 | A | * | 9/1975 | Frierman | 473/41 |
| 3,912,272 | A | * | 10/1975 | Hicks et al. | 273/119 R |
| 4,004,804 | A | * | 1/1977 | Gholson | 473/14 |
| 4,294,449 | A | * | 10/1981 | Shaw | 473/20 |
| 6,513,807 | B1 | * | 2/2003 | Lynch | 273/119 R |
| 6,537,156 | B1 | * | 3/2003 | Stagg | 473/40 |
| 7,192,358 | B2 | * | 3/2007 | Knupp | 473/40 |
| 7,722,471 | B2 | * | 5/2010 | Smith | 473/1 |
| 2004/0254024 | A1 | * | 12/2004 | Thomas | 473/2 |
| 2012/0316003 | A1 | * | 12/2012 | Curtwright | 473/40 |

* cited by examiner

*Primary Examiner* — Mitra Aryanpour
(74) *Attorney, Agent, or Firm* — Billion & Armitage; Richard E. Billion

(57) ABSTRACT

A billiard rack design providing a perfect line-up of the balls with the diamonds on a pool table. When compression a ball in the corner of the slots makes for a perfect rack. The point on the removable markers (4) will line the rack up with the diamonds on the pool table. In addition by slightly tipping the rack before removing it from the balls, makes for an steady accurate rack, and will not the disturb the other rack balls. These racks may come in different sizes to fit for 6, 7, 8, 9 ball pool tables.

7 Claims, 3 Drawing Sheets

BILLIARD RACK

This application claims the benefit of U.S. Provisional Application No. 61/520,648, filed on 13 Jun. 2011, the contents of which are incorporated herein by reference. A claim of priority is made.

The present invention relates to billiard racks for pool or billiard balls and more particularly to an improved such device that simplifies the racking operation while assuring a tight racking of the balls.

BACKGROUND OF THE INVENTION

In the racking of pocket pool or billiard balls prior to the initiation of play, the balls are placed in a line across the table, in threes.

The balls will be lined up on the table, from diamond to diamond., placed in the rack with three of the slots. When finished if desired to use all 15 balls, and in some cases less balls, it will appear in a grid view on the pool table.

It also comes in 4 different sizes, for 6, 7, 8, 9 foot pool tables.

OBJECT OF THE INVENTION

This rack was designed to play a pool game, called the Nine Inning Grid Game, Or other factors or games, to put the ball in a grid pattern on a pool table.

By using this rack, it will help improve and get a perfect grid of balls, or line of balls on the pool table.

DETAIL DESCRIPTION

Figure 1:
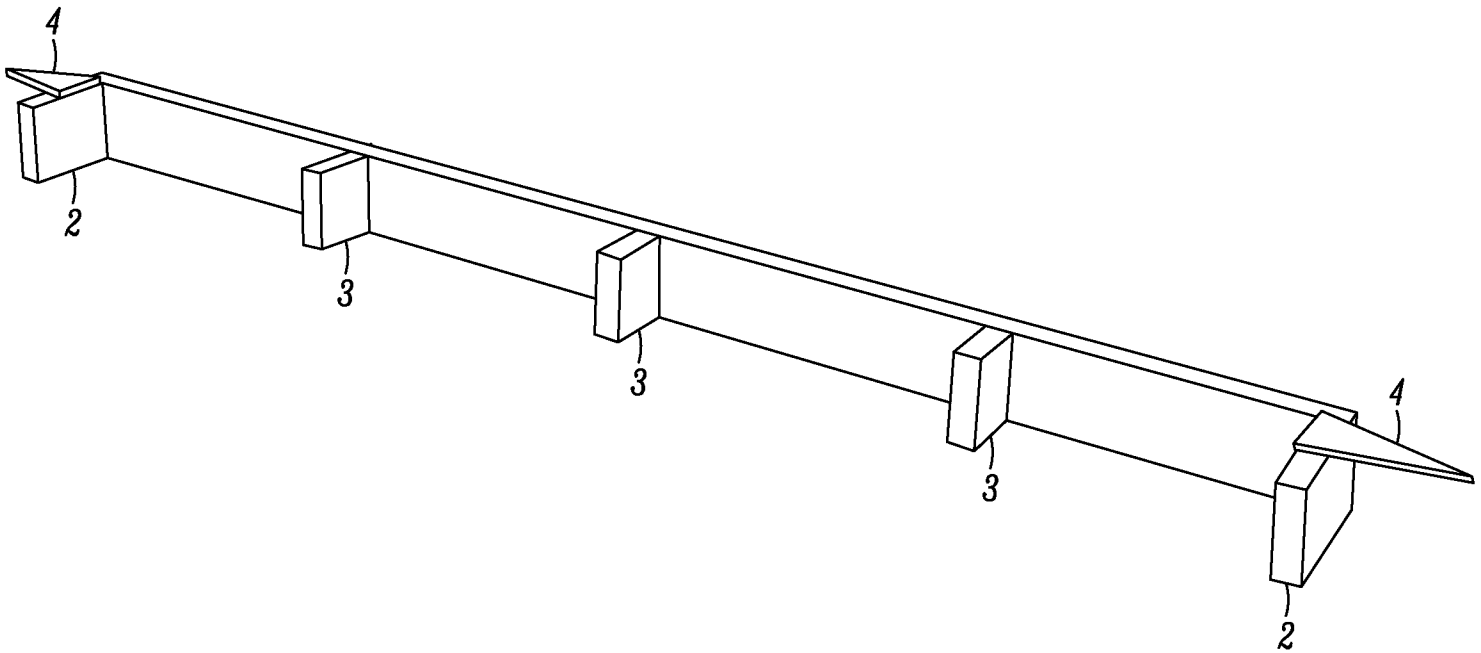
FIG. 1 Is a moderately phantom perspective plan view of the billiard rack of the present invention oriented with numbers.

Referring to FIG. 1 displays the back board (5) which supports the other supports. And there is the side supports which fits along the inside of the pool table (2) giving it enough space to be able to slide down the sides of the pool table. The pointers, or markers (4) help line up back support and the center supports (3), by placing the Pointers (4) right at the diamonds on the pool table will give you a perfect line. This apparatus's material may be of wood, plastic, or any other supportive materials. The center support (3) is were the balls are placed using the fingers or thumbs to push the balls in the corner of the supports (5) and (3) making a tight fit.

Figure 2:
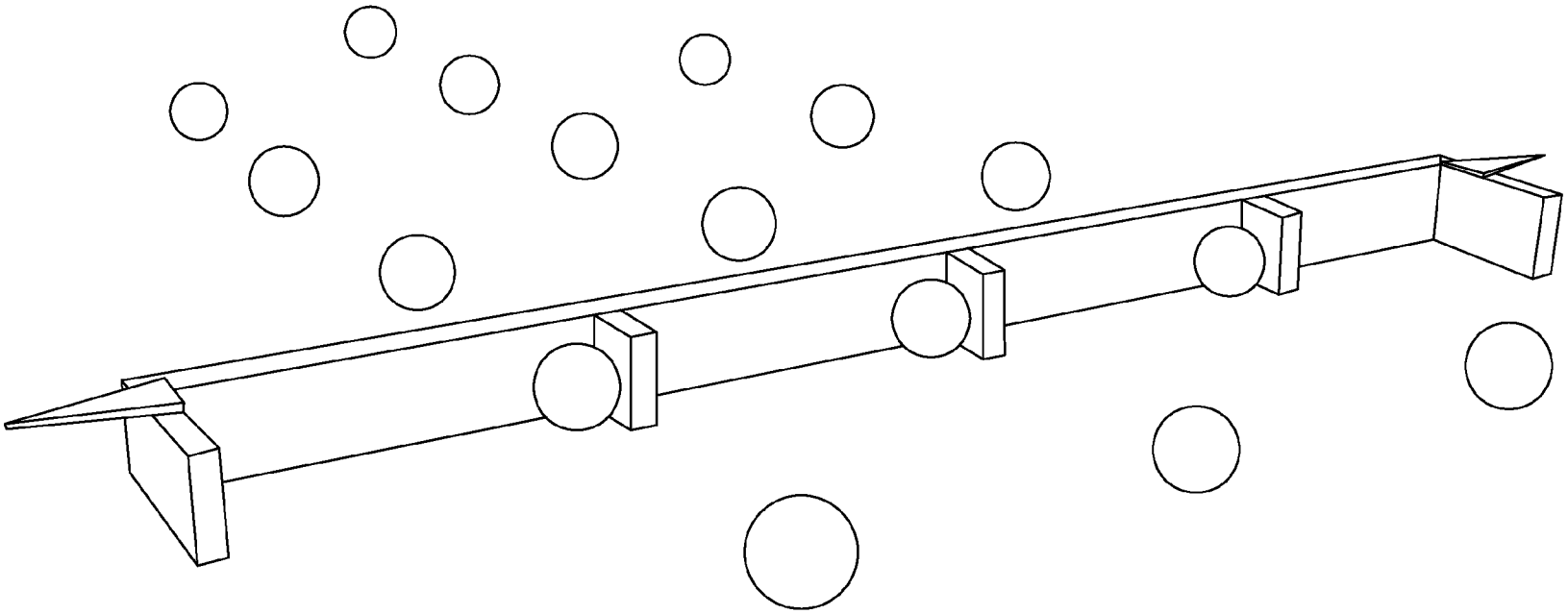
FIG. 2 Is a moderately phantom top plan view of the billiard rack, with ball fitting tightly in place.
Figure 3:
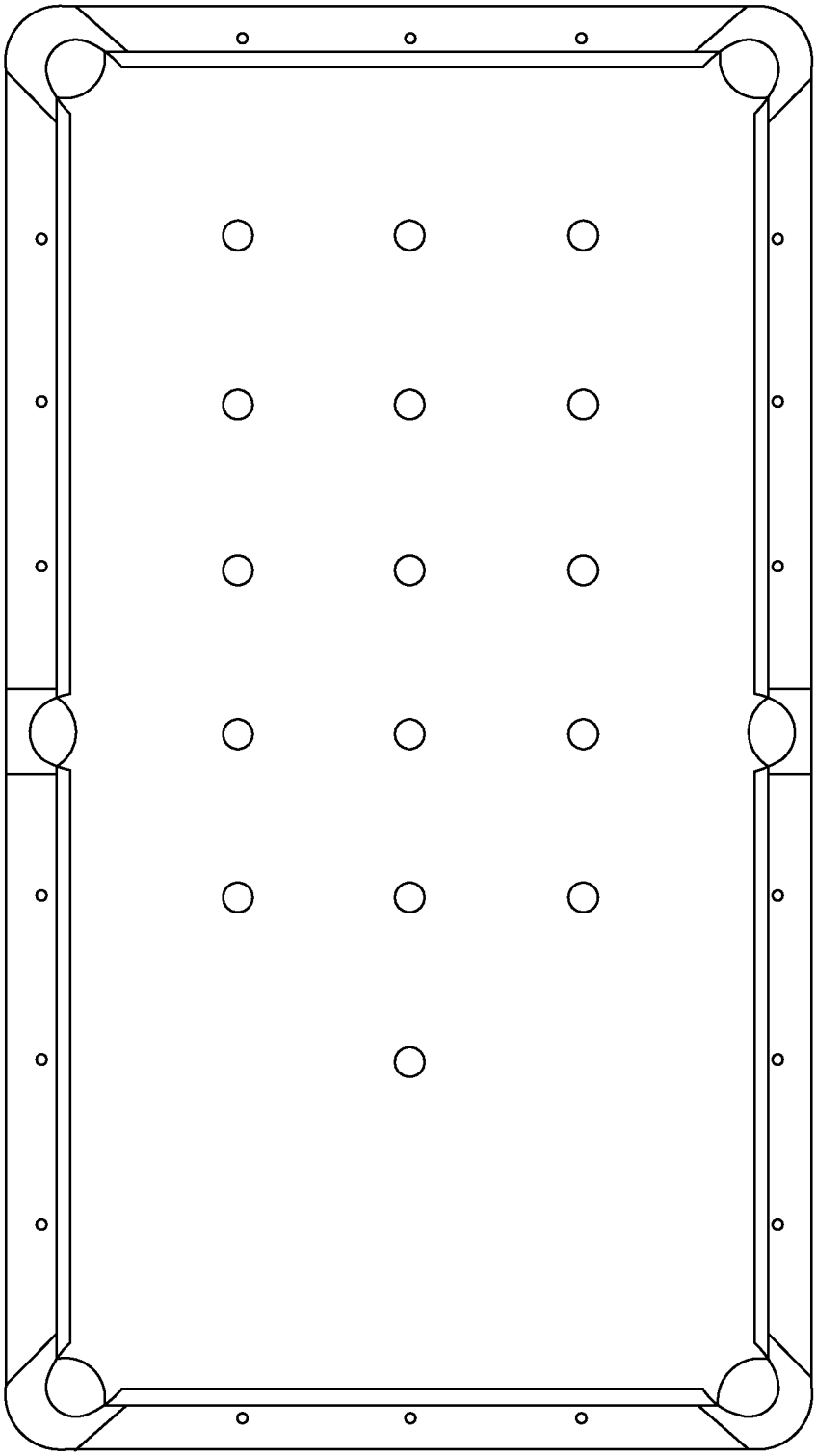
FIG. 3 is a top plan view of the lining of the balls with the diamond marks on the sides of a pool table.

Referring to FIG. 2 shows a top view of the billiard rack, also shows the placements of the balls, and how the billiard rack is used, placing the ball in the slots (3) sliding the balls down the rails or inside of the pool tables. By lining them up to the diamonds with the markers (4) on the side supports (2)

Nine Inning Grid Game

Racking

Place all the balls you want to use on the table, if you are playing with 15 balls. Line up the "Grid Rack" cross way of the table, line up the markers on the rack to the first set of diamonds on the long rails. Place three balls into the slots, making sure the balls are lined up with the diamonds on the short rails. And now proceed to the other set of diamonds. When lining rack up with the side pocket, have a center mark on the pocket to help line up the rack. Then use the rack 4 to line up the cue ball in the center on the next set of diamonds. So when finished you have a grid pattern on the table, see FIG. 4.

Play Game

This is with two players: First Inning: Call all pockets if you wish, Player1 shoots till they miss or scratch, count the balls they made then put on score card. Now rack the balls again, Player2 shoots till they miss or scratch, count the balls they made then put on score card. Second Inning: Repeat this process until you play all innings. Total up the balls at the end of the innings, or if there is a tie then play another inning.

What is claimed is:

1. A ball rack for racking a plurality of balls when playing a billiard-type game such as a novel game of Nine-Inning grid, the ball rack comprising:

an elongate support having a front, a back and two sides;

a pair of end supports transversely attached to the sides and front of the elongate support;

a plurality of spaced apart transverse positioning members positioned between the pair of end supports, the plurality of positioning members are attached to the front of the elongate support; and a pair of pointers positioned one on each of the pair of ends support, wherein the pair of pointers aid in aligning the ball rack with the diamonds on a billiard table.

2. The ball rack of claim 1, wherein the ball rack is made of wood.

3. The ball rack of claim 1, wherein the ball rack is made of plastic.

4. The ball rack of claim 1 wherein there are three spaced apart transverse positioning members positioned between the pair of end supports.

5. The ball rack of claim 1 wherein the pair of end supports each have a top surface, each of the pair of pointers positioned on tops of the pair of end supports proximate the end of elongate support.

6. The ball rack of claim 1 wherein the pair of pointers are triangular in shape.

7. The ball rack of claim 1 further including instructions.

* * * * *